US009328672B2

(12) United States Patent
Serrano et al.

(10) Patent No.: US 9,328,672 B2
(45) Date of Patent: May 3, 2016

(54) ENGINE BRAKING CONTROLLER

(71) Applicant: Tula Technology, Inc., San Jose, CA (US)

(72) Inventors: Louis J. Serrano, Los Gatos, CA (US); Steven E. Carlson, Oakland, CA (US); Joshua P. Switkes, Menlo Park, CA (US); Ronald D. Yuille, Sarasota, FL (US)

(73) Assignee: Tula Technology, Inc., San Jose, CA (US)

( * ) Notice: Subject to any disclaimer, the term of this patent is extended or adjusted under 35 U.S.C. 154(b) by 353 days.

(21) Appl. No.: 13/953,615

(22) Filed: Jul. 29, 2013

(65) Prior Publication Data

US 2014/0034010 A1 Feb. 6, 2014

Related U.S. Application Data

(60) Provisional application No. 61/677,888, filed on Jul. 31, 2012, provisional application No. 61/683,553, filed on Aug. 15, 2012.

(51) Int. Cl.
*F02D 13/04* (2006.01)
*F02D 41/00* (2006.01)
(Continued)

(52) U.S. Cl.
CPC ..... *F02D 17/02* (2013.01); *F02D 13/04* (2013.01); *F02D 41/0087* (2013.01); *F02D 41/123* (2013.01); *F02D 13/0203* (2013.01); *F02D 41/0005* (2013.01)

(58) Field of Classification Search
CPC . F02D 13/04; F02D 13/0203; F02D 13/0257; F02D 9/06; F02D 17/02; F02D 17/023; F02D 41/0087; F02D 41/0025; F02D 41/123; F02D 41/0005; F02D 41/0085; F02D 41/045; F02D 41/1446; F02D 2041/0012; F02D 2200/0802
USPC ..... 123/304, 322, 481
See application file for complete search history.

(56) References Cited

U.S. PATENT DOCUMENTS 4,204,483 A * 5/1980 Harada ..... F02D 41/123 123/493
4,274,382 A 6/1981 Sugasawa et al.
(Continued)

FOREIGN PATENT DOCUMENTS

JP 2002-089307 3/2002

OTHER PUBLICATIONS

International Search Report dated Oct. 18, 2013 from International Application No. PCT/US2013/052577.
(Continued)

*Primary Examiner* — Lindsay Low
*Assistant Examiner* — George Jin
(74) *Attorney, Agent, or Firm* — Beyer Law Group LLP

(57) ABSTRACT

In one aspect of the invention, an engine is operated in a skip cylinder engine braking mode. In the skip cylinder engine braking mode, selected working cycles of selected working chambers are deactivated. Other selected working cycles of the selected working chambers are operated in a braking mode. Accordingly, individual working chambers are sometimes deactivated and sometimes operated in the braking mode while the engine is operating in the skip cylinder engine braking mode. Various methods for cylinder control are described, which improve fuel economy, catalytic converter performance, and vehicle NVH characteristics.

29 Claims, 3 Drawing Sheets

(51) Int. Cl.

| | |
|---|---|
| ***F02D 17/02*** | (2006.01) |
| ***F02D 41/12*** | (2006.01) |
| *F02D 13/02* | (2006.01) |

(56) References Cited

U.S. PATENT DOCUMENTS

| | | | | |
|---|---|---|---|---|
| 4,276,863 | A * | 7/1981 | Sugasawa | F02D 41/0087 123/198 F |
| 4,305,365 | A | 12/1981 | Iizuka et al. | |
| 4,434,767 | A | 3/1984 | Kohama et al. | |
| 4,489,695 | A | 12/1984 | Kohama et al. | |
| 4,509,488 | A | 4/1985 | Forster et al. | |
| 5,117,790 | A * | 6/1992 | Clarke | F02D 13/0203 123/198 F |
| 5,377,631 | A | 1/1995 | Schechter | |
| 5,669,357 | A | 9/1997 | Denz et al. | |
| 5,769,054 | A | 6/1998 | Schnaibel et al. | |
| 5,975,052 | A * | 11/1999 | Moyer | F01B 17/02 123/198 F |
| 6,158,411 | A | 12/2000 | Morikawa | |
| 6,553,962 | B1 * | 4/2003 | Russ | F02D 13/06 123/322 |
| 6,615,776 | B1 | 9/2003 | Von Andrian-Werburg | |
| 6,619,258 | B2 * | 9/2003 | McKay | F01L 13/0005 123/198 F |
| 6,625,535 | B2 * | 9/2003 | Han | B60T 8/18 477/94 |
| 7,063,062 | B2 | 6/2006 | Lewis et al. | |
| 7,066,136 | B2 | 6/2006 | Ogiso | |
| 7,080,625 | B2 | 7/2006 | Albertson et al. | |
| 7,086,386 | B2 | 8/2006 | Doering | |
| 7,249,583 | B2 | 7/2007 | Bidner et al. | |
| 7,308,886 | B2 | 12/2007 | Balles et al. | |
| 7,308,962 | B2 | 12/2007 | Sen et al. | |
| 7,503,312 | B2 | 3/2009 | Surnilla et al. | |
| 7,566,103 | B2 * | 7/2009 | Wanner | B60W 10/06 303/155 |
| 7,577,511 | B1 | 8/2009 | Tripathi et al. | |
| 7,849,835 | B2 | 12/2010 | Tripathi et al. | |
| 7,886,715 | B2 | 2/2011 | Tripathi et al. | |
| 7,900,596 | B2 * | 3/2011 | Hartmann | F02D 13/0207 123/198 F |
| 7,930,087 | B2 * | 4/2011 | Gibson | F02D 13/04 123/321 |
| 7,941,994 | B2 | 5/2011 | Surnilla et al. | |
| 7,954,474 | B2 | 6/2011 | Tripathi et al. | |
| 8,099,224 | B2 | 1/2012 | Tripathi et al. | |
| 8,131,445 | B2 | 3/2012 | Tripathi et al. | |
| 8,131,447 | B2 | 3/2012 | Tripathi et al. | |
| 8,606,483 | B2 | 12/2013 | Krupadanam et al. | |
| 2004/0163866 | A1 * | 8/2004 | Sen | B60K 31/04 180/179 |
| 2005/0182553 | A1 | 8/2005 | Miller et al. | |
| 2005/0193980 | A1 * | 9/2005 | Doering | F01N 3/0814 123/406.47 |
| 2005/0272560 | A1 * | 12/2005 | Doering | B60W 10/06 477/186 |
| 2006/0032479 | A1 | 2/2006 | Megli et al. | |
| 2007/0051350 | A1 | 3/2007 | Pallet et al. | |
| 2008/0041336 | A1 | 2/2008 | Gibson et al. | |
| 2010/0010724 | A1 | 1/2010 | Tripathi et al. | |
| 2010/0050993 | A1 | 3/2010 | Zhao et al. | |
| 2011/0130902 | A1 * | 6/2011 | Heisel | B60K 6/485 701/22 |
| 2012/0017868 | A1 | 1/2012 | Rammer et al. | |
| 2015/0191168 | A1 * | 7/2015 | Mitsuyasu | B60W 20/00 701/54 |

OTHER PUBLICATIONS

Written Opinion dated Oct. 18, 2013 from International Application No. PCT/US2013/052577.

* cited by examiner

ENGINE BRAKING CONTROLLER

CROSS REFERENCE TO RELATED APPLICATIONS

This application claims priority of Provisional Application Nos. 61/677,888 filed Jul. 31, 2012 and 61/683,553 filed Aug. 15, 2012, each of which is incorporated herein by reference in its entirety for all purposes.

FIELD OF THE INVENTION

The present invention relates generally to engine braking technologies and particularly to the use of skip cylinder engine braking techniques to control the amount of engine braking.

BACKGROUND

Most vehicles in operation today (and many other devices) are powered by internal combustion (IC) engines. Internal combustion engines typically have a plurality of cylinders or other working chambers where combustion occurs. For example, when a driver presses the accelerator pedal, air and fuel are delivered to the working chambers. The fuel is ignited, resulting in combustion that drives pistons within the engine. The pistons in turn are indirectly coupled to the wheels of the vehicle through the drive train such that reciprocation of the pistons causes the wheels to rotate.

When a driver seeks to slow the vehicle down, he/she can depress the brake pedal or simply release the accelerator pedal, which often induces engine braking. Engine braking involves using pumping losses and/or friction within the engine to reduce the speed of the vehicle. For example, if a manual transmission car is kept in gear and allowed to roll down an incline, it would roll substantially more slowly than if the car were in neutral. This is because the wheels of the car are coupled with the pistons in the engine when the car is in gear. As the pistons move back and forth, friction and pumping losses are generated that slow the car down.

There are a wide variety of ways for engine braking to take place. For example, during engine braking some vehicles tend to fire all the working chambers of the engine, but with minimal amounts of air and fuel. In other implementations, the car enters into a temporary mode commonly referred to as deceleration fuel cutoff (DFCO). In this mode, only air, but not fuel, is passed through all the working chambers. This can help improve fuel economy. However, passing too much air through the working chambers of the engine can negatively impact the performance of the catalytic converter.

Another approach, which is described in U.S. Pat. No. 7,930,087 (hereinafter referred to as the '087 patent), involves manipulating the intake or exhaust valves on one or more cylinders to introduce and discharge air from the cylinders. The passage of air generates pumping losses and negative torque for those cylinders. In the other cylinders, air flow is restricted or cut off so that pumping losses are minimized. To increase the amount of negative torque, air can be passed through a greater number of the engine's cylinders.

Although the above approaches work well for various applications, the present invention seeks to provide improved engine braking designs.

SUMMARY

A variety of methods and arrangements for improving engine braking in internal combustion engines are described.

In one aspect of the invention, a desired amount of engine braking is determined and the engine is operated in a skip cylinder engine braking mode that delivers the desired amount of engine braking. In the skip cylinder engine braking mode, selected working cycles of selected working chambers are deactivated and other selected working cycles of the selected working chambers are operated in a braking mode. Accordingly, individual working chambers are sometimes deactivated and sometimes operated in the braking mode while the engine is operating in the skip cylinder engine braking mode.

Skip cylinder engine braking mode can be used to obtain a high degree of control over engine braking. In some prior art approaches, a particular working chamber, or all the working chambers, are locked into a particular mode of operation during engine braking. This need not be the case with skip cylinder engine braking mode. In skip cylinder engine braking mode, the working chamber may change states, from a deactivated state to braking mode and vice versa, from one working cycle to the next. Accordingly, the skip cylinder engine braking mode allows for a wide variety of different engine braking levels. A variety of other engine parameters may be used to further control the amount of braking force, including but not limited to the manifold absolute pressure, gear setting, cam/valve timing and/or throttle position.

The engine braking implementations described herein may be used in a wide variety of situations. In some designs, for example, skip cylinder engine braking mode is used to slow a vehicle when a vehicle is decelerating and coasting. The mode may also be used in conjunction with cruise control and/or to supplement the braking force vehicle braking system.

In various implementations, operating a working chamber in braking mode involves delivering a small amount of fuel and air into the working chamber. Despite the positive torque generated by combustion, the working chamber generates net negative torque due to high pumping losses. In other implementations, the braking mode involves pumping air through the associated working chamber without injecting any fuel. This approach is more fuel efficient, but over prolonged periods can negatively impact vehicle emissions. In still other embodiments, air is allowed into and out of the associated working chamber through either the intake valve or the exhaust valve. In another embodiment, during some periods there is no braking and all the working chambers are deactivated, while in other periods one or more of the working chambers are in a braking mode.

In another aspect of the invention, an engine braking controller includes a braking fraction determining unit and a braking timing determining unit. The braking fraction determining unit is arranged to determine a braking fraction, which indicates the number of working cycles to operate in a braking mode to deliver a desired amount of engine braking. The available braking fractions are not limited to the use of integer numbers of working chambers. The braking timing determining unit is arranged to direct the operation of working chambers in a manner that delivers the selected braking fraction. The selected braking fraction can help determine the average negative torque produced from the engine braking. In one example embodiment, the maximum negative torque is produced if all cylinders are in the braking mode, e.g., the fraction of cylinders in braking mode equals 1. In this example, approximately one third of the maximum negative torque is produced if one third of the cylinders are in the braking mode. In various embodiments, working chambers are individually controlled and/or selectively operated in a braking mode on a working cycle by working cycle basis. Implementing a skip cylinder engine braking mode allows the system to meter the amount of engine braking within the physical limits of what pumping loss incurs.

The engine braking controller may include a wide variety of additional components, which may be separate or integrated together. For example, one implementation involves a catalyst monitor that monitors a catalytic converter. The engine braking controller is arranged to occasionally fire selected working cycles of at least one selected working chamber to help condition the catalytic converter based at least in part on input from the catalyst monitor. The engine braking controller may also include a sigma delta converter and/or a power train parameter adjusting module that is arranged to adjust engine settings. For example, the throttle may be adjusted to control the manifold absolute pressure (MAP), which influences the amount of engine braking. Similarly, the intake and exhaust valve timing, may be adjusted to influence the amount of engine braking. For a spark ignition engine, the spark timing may be adjusted to reduce the torque generated when a cylinder is fueled and fired.

In another aspect of the invention, a braking fraction is set that indicates a fraction of working cycles to operate in a braking mode to deliver a desired amount of engine braking. A braking pattern is determined that indicates on a working cycle by working cycle basis whether selected working chambers should be operated in a braking mode or deactivated. Each time a working chamber is operated in the braking mode, air is introduced into the working chamber in a manner that causes pumping work that help deliver the desired amount of engine braking. Each time a working chamber is deactivated, air flowing through the deactivated working chamber is restricted such that pumping losses (or work) are minimized. In various embodiments, the airflow through the cylinder may be (i) from intake port to exhaust port, (ii) in and out of the intake port, or (iii) in and out of the exhaust port. Fuel may or may not be delivered to the working chamber in each of these approaches.

In another aspect of the invention, multiple working chambers of an engine are arranged in first and second banks. Each bank of working chambers is coupled with separate first and second catalytic converters, respectively. The working chambers in the first bank are deactivated. The working chambers in the second bank are operated such that engine braking is generated from the second bank. Fuel is not delivered to these working chambers. Accordingly, air flow is channeled primarily through the corresponding second catalytic converter. An advantage of this aspect of the invention is that the unused catalyst stays warmer, improving conversion efficiency when it is used again. In addition, since no air is flowing through the converter, oxygen saturation of the catalyst is not a problem.

BRIEF DESCRIPTION OF THE DRAWINGS

The invention and the advantages thereof, may best be understood by reference to the following description taken in conjunction with the accompanying drawings in which.

In the drawings, like reference numerals are sometimes used to designate like structural elements. It should also be appreciated that the depictions in the figures are diagrammatic and not to scale.

DETAILED DESCRIPTION

The present invention relates generally to an engine braking controller and related methods. More specifically, the present invention involves performing engine braking in a manner that allows greater control over the amount of negative torque generated through engine braking. The engine may be an internal combustion engine that supplies power to drive a vehicle. The engine may have a single working chamber or a plurality of working chambers. The engine may utilize spark or compression ignition.

As discussed in the Background section, a variety of methods have been proposed that contemplate controlling the amount of engine braking provided in specific situations. For example, in U.S. Pat. No. 7,930,087, air is passed through one, some or all of the cylinders, while the rest are deactivated and sealed. The amount of engine braking can be increased by increasing the number of cylinders that allow for the passage of air. However, this design, while effective in some applications, has several limitations. For one, the braking fraction (i.e., the fraction or percentage of the cylinders that allow the passage of air and generate pumping work to promote engine braking) appears to be limited to an integer number of the total number of cylinders in the engine. This feature limits the number of possible levels of engine braking.

Various embodiments of the present invention address these limitations. For example, some implementations involve operating the engine in a skip cylinder engine braking mode. That is, in the skip cylinder engine braking mode, selected working cycles of selected working chambers are deactivated while other selected working cycles of selected working chambers are operated in a braking mode. (Generally, "braking mode" refers to a mode in which air is allowed into the associated working chamber to generate substantial pumping losses that contribute to engine braking. This is in contrast to a deactivated cylinder, which is sealed by leaving the intake and exhaust valves seated to restrict or cut off air flow. Pumping work is minimized as the piston moves up and down in a spring-like manner. A deactivated cylinder thus contributes very little to engine braking.)

Accordingly, various implementations of the present invention allow for greater flexibility and control over the operation of the individual working chambers in engine braking. Select working cycles can be selectively chosen to be in either braking mode or in a deactivated state. This can be performed on a working cycle by working cycle basis. Additionally, this approach does not require operating each working chamber in a particular, fixed mode over a period of time. Rather, a working chamber may be in a braking mode during one working cycle and deactivated during the next. This increases the number of possible engine braking levels.

Figure 1:
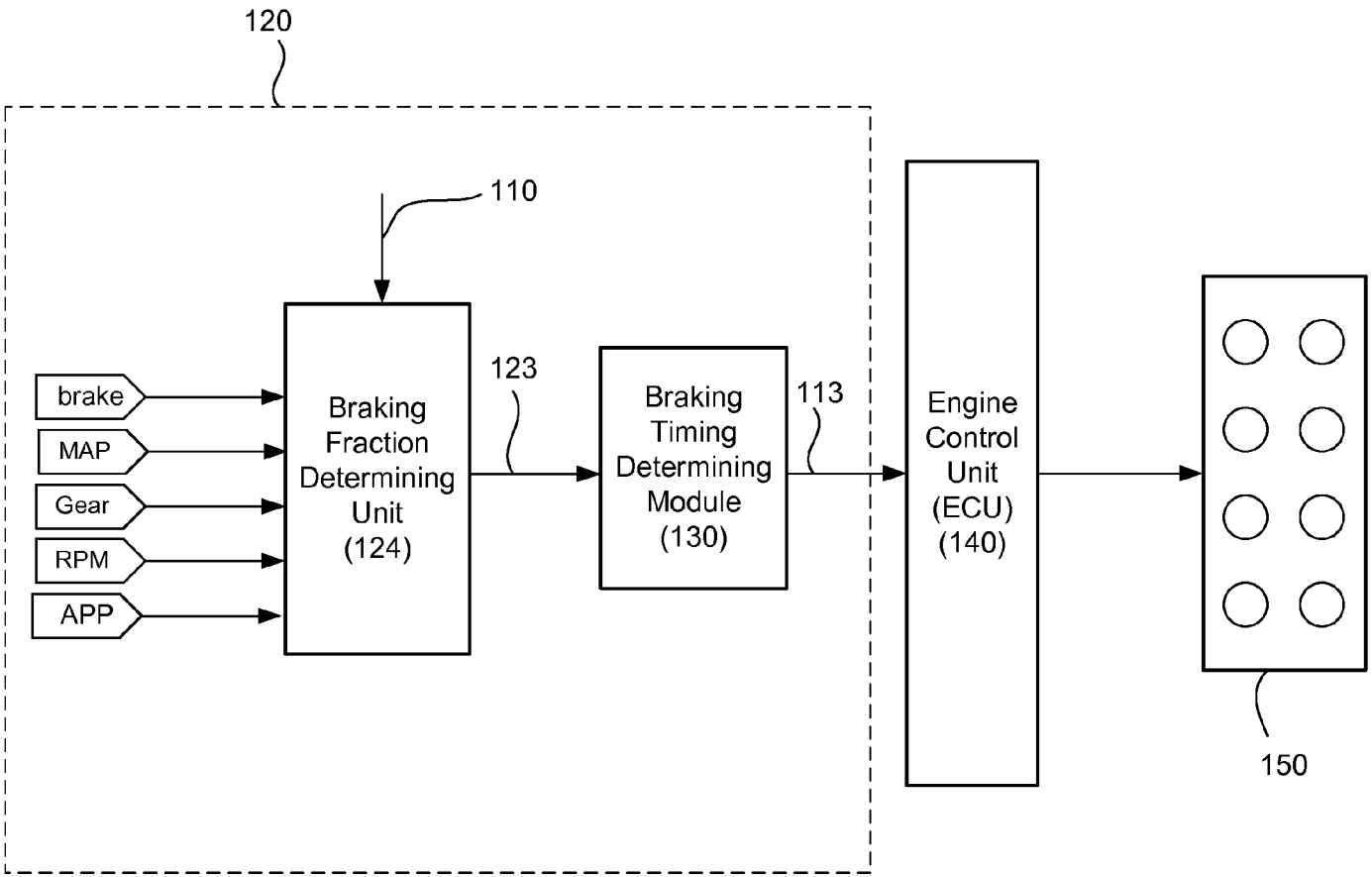
FIG. 1 is a block diagram of an engine braking controller according to a particular embodiment of the present invention.

Referring next to FIG. 1, an engine braking controller 120 in accordance with one embodiment of the present invention will be described. The engine braking controller 120 includes a braking fraction determining unit 124 that is arranged to work in conjunction with engine control unit (ECU) 140. The illustrated engine braking controller 120 also includes a braking timing determining module 130. In other embodiments, the various units and modules are integrated into the ECU 140. The ECU is coupled with an engine 150 that has multiple working chambers.

Although the embodiment in FIG. 1 illustrates a control path for engine braking, some implementations contemplate using the same control path to also regulate engine firing. The assignee of the present application has filed several patent applications that describe compatible skip fire technologies, such as U.S. Pat. Nos. 7,954,474; 7,886,715; 7,849,835; 7,577,511; 8,099,224; 8,131,445; and 8,131,447; U.S. patent application Ser. Nos. 13/004,839 and 13/004,844; and U.S. Provisional Patent Application Nos. 61/080,192, 61/104,222; 61/104,222; and 61/640,646 (hereinafter referred to as the '646 application), each of which is incorporated herein by reference in its entirety for all purposes. Any of the functionality and components for skip fire control that are described in the above patents and applications can be integrated into the control path illustrated in FIG. 1. In other embodiments, the control paths for engine braking and engine firing are separate.

Signal 110 is a requested torque and/or output (which would typically be a negative value) and may come from any suitable source such as a cruise controller (not shown). For example, the requested torque may be based on a desired speed set using the cruise controller.

The braking fraction determining unit 124 also may receive a variety of other input signals. The input signals may be received or derived from a variety of suitable sources, including an indication of the accelerator pedal position (e.g. from, an accelerator pedal position (APP) sensor), an indication of the MAP (manifold absolute pressure) and/or the MAC (mass air charge), a brake pedal position sensor, gear settings, intake and exhaust valve timing, engine speed (RPM) etc. Based on the requested torque indicated by signal 110 and possibly the other input signals, the unit 124 determines a corresponding braking fraction. In addition to the braking fraction, various implementations of the unit 124 also adjust other engine parameters to help control the amount of engine braking, including but not limited to the throttle position and manifold absolute pressure.

The braking fraction indicates the number of working cycles to operate in a braking mode to deliver the desired amount of engine braking. To use one simple example, a braking fraction of 30% may indicate that during approximately 30% of the working cycles, the corresponding working chambers of the engine are in braking mode over a particular period of time and that during the remaining 70% of the working cycles, the corresponding working chambers are deactivated, although it should be appreciated that the braking fraction can be represented in a wide variety of other ways. The braking fraction is outputted in the form of commanded braking fraction signal 123, which is indicative of the effective braking fraction that the engine is expected to generate.

The braking fraction may be based at least partly on any of the aforementioned input signals. For example, if the MAP is very low, there tends to be greater pumping losses because more work is required to draw air from the intake manifold into the working chamber. Accordingly, a lower braking fraction may be sufficient to produce the desired amount of engine braking. Similarly adjustment of the intake and exhaust valve timing influences the amount of air entering and exiting a cylinder and thus impacts pumping work. Control of valve timing can be used in conjunction with the MAP and braking fraction to achieve the desired level of engine braking.

There may be numerous possible effective braking fractions. In some implementations, the braking fractions may be selected from a predetermined set of possible braking fractions. Generally, the available braking fractions are not limited to an integer numbers of working chambers. For example, in an eight-cylinder engine, the braking fraction is not limited to X/8 where X is an integer equal to or less than 8.

The braking timing determining module 130 receives the commanded braking fraction signal 123. The module 130 is arranged to issue a sequence of braking commands (e.g., braking pulse signal 113) that cause the engine to substantially deliver the percentage of working cycles in braking mode as dictated by the commanded braking fraction 123. The firing/braking timing determining module 130 may take a wide variety of different forms. For example, in some of the described embodiments, the braking timing determining module 130 includes a sigma-delta converter. In other embodiments, the module 130 may utilize other types of converters or various types of lookup tables to implement the desired control algorithms. The braking pulse signal 113 outputted by the braking timing determining module 130 may be passed to an engine control unit (ECU) 140 which orchestrates the actual braking mode activations.

When a particular working cycle arises for a particular working chamber, the braking pulse signal 113 indicates whether the working chamber should be operated in a braking mode or deactivated. In various preferred embodiments, the working chambers are individually controlled such that this decision is made on a working cycle by working cycle basis. This differs from the prior art engine braking mechanism described in the aforementioned '087 patent, in which only an integer number of the available working chambers allow air for engine braking, while the rest are deactivated. The overall pattern of the braking pulse signal 113 is arranged to deliver the desired amount of engine braking.

In the most general sense, braking mode refers to any mode of operating a working chamber to produce pumping work and help facilitate engine braking. Put another way, a working chamber operated in braking mode generates net negative torque or contributes substantially to engine braking. The actual operations involved in a particular working chamber in braking mode can vary between different implementations. One approach is to pass only air, but not fuel through the working chamber. Another approach is to deliver and ignite fuel. The amount of fuel and air that is delivered into the working chamber is small enough such that the net torque generated by the working chamber is still negative. The two approaches can be selectively implemented for particular braking mode working cycles or one of the approaches can be used for most or all of the braking mode working cycles. In some embodiments, for example, during a selected number of working cycles, braking mode may involve the delivery of air, but not fuel to the working chamber. During one or more other working cycles, the braking mode may involve the delivery of both air and fuel. As will be discussed below, too much of the former can degrade the performance of a catalytic converter, while the latter can be used to remedy this problem.

In various implementations in which braking mode at least sometimes involves passing uncombusted (and thus unheated) air, through the corresponding working chamber, the manner in which braking mode is implemented involves balancing fuel efficiency, engine braking power and vehicle emissions. Modern vehicles have catalytic converters on the engine exhaust that convert environmentally harmful exhaust gases into a more benign waste stream. Efficient catalyst performance occurs at an elevated temperature. Passing unheated air (since there was no combustion process) through the converter can lower its temperature, degrading subsequent performance when combustion gases flow through the converter. Air also has a different chemical makeup than a combusted air/fuel mixture. In particular, the oxygen level in air is much higher than in a combusted air/fuel mixture. The catalytic converter performance can be temporarily degraded if too much oxygen is passed through it. The performance can be restored by conditioning the catalyst with the appropriate exhaust gas chemistry. The exhaust gas chemistry can be controlled by varying the air/fuel ratio to yield different combustion products and different oxygen levels in the exhaust gases. Delivering fuel to the working chamber, igniting the fuel and passing the exhaust through the catalytic converter may help restore the functionality of the catalytic converter. Although the working chamber is firing, the pumping work of the working chamber may still outweigh the work generated by combustion of the fuel. The positive torque generated by a combustion event may be reduced by retarding the spark timing in a spark ignition engine. Such combustion need not take place every time a working chamber is in braking mode, but rather can be performed sporadically or just enough to properly condition the catalytic converter. Accordingly, fuel efficiency can be improved in comparison to conventional vehicles, which, when not in DFCO, tend to fire every working chamber while engine braking. Fuel economy may also be improved by managing the engine operation so that less fuel is required to restore catalytic converter performance.

Generally, deactivating a working chamber refers to restricting or cutting off air flow into the working chamber to minimize pumping losses. If the working chamber is sealed off such that air is prevented from entering or escaping, the piston functions like a spring that conserves energy. For example, a vacuum in the combustion chamber that pulls against the piston as it moves towards bottom dead centre (BDC) will help the piston move back towards top dead center (TDC) in a later part of the stroke. Of course, there may be some small energy losses due to friction, but the general purpose of deactivating the working chamber is to contribute as little to engine braking as possible.

It should be appreciated that what operations make up a braking mode or a deactivated working chamber may differ at different times and under different driving conditions. For example, under certain conditions, the engine braking controller may engage a deceleration fuel cutoff (DFCO) mode that prevents any fuel from being delivered to any of the working chambers. That is, working chambers in braking mode will allow in air, but not fuel. At some point, it is then determined that DFCO should be terminated and that fuel should be delivered to one or more of the working chambers in braking mode during one or more selected working cycles. This mechanism helps prevent too much uncombusted air from flowing through the catalytic converter.

The present invention also contemplates some embodiments in which the intake and/or exhaust valves are individually or electronically controlled in an unconventional manner. Accordingly, the timing of the valves can then be adjusted to generate the desired amount of pumping losses. In a particular implementation, the intake valve may be opened briefly when the piston is in the vicinity of BDC (e.g., at the beginning of the compression stroke in a four-stroke engine). Such air is compressed in a conventional manner as the piston moves towards TDC, thus inducing pumping losses ("compression braking."). The intake valve may then be briefly opened when the piston is at or near top dead centre (TDC) (e.g., at the end of the compression stroke). The compressed air then escapes through the same intake valve. Only a small amount of air is left in the working chamber, which creates a vacuum that pulls against the piston as it moves back towards BDC ("expansion braking.") This process can be performed using only the exhaust valve as well. Accordingly, in this implementation air is not pumped through the working chamber (i.e., in through the intake valve and out the exhaust valve), but instead enters and exits the working chamber through the same valve. In still another embodiment, air may be introduced through the intake port and exhausted through the exhaust port in a two stroke braking mode. An advantage of these approaches is that they can provide substantial amounts of engine braking without passing fresh, unheated air through the catalytic converter.

The engine braking controller 120 is arranged to automatically generate a commanded braking fraction 123 and a corresponding braking pulse signal 113 in response to particular types of driving conditions. In one implementation, the braking fraction determining unit 124 receives the signal 110 from the cruise controller requesting a selected amount of negative engine torque. (This may be desirable, for example, in a situation where the vehicle is coasting down a hill in a manner such that the targeted vehicle speed is being exceeded.) Based upon the requested negative torque, the unit 124 would then determine a braking fraction that is suitable for delivering the desired negative engine torque given the vehicle's current operating conditions. In another embodiment, a target vehicle speed is set using cruise control and the braking fraction is set to substantially reach the target speed. In another implementation involving a hybrid vehicle with regenerative braking, the unit 124 monitors whether the kinetic energy return system (KERS) is engaged. If so, engine braking may be disengaged or reduced to maximize the amount of regenerative braking. In a third implementation, the unit 124 determines that the brake pedal is being depressed. In response, the unit generates a braking fraction to help supplement the action of the brake pads with additional engine braking. The ratio of negative torque generated by engine braking and engagement of the brake pads may be controlled. For example in some situations it may be desirable to minimize engine braking so as to reduce air being pumped through the catalytic converter. Skip cylinder engine braking mode can be applied to any condition in which it is desirable to have a wide range of possible engine braking levels. An advantage of engine braking is that it decreases wear on the brake pads extending their useful life.

Some designs contemplate using skip cylinder engine braking mode and/or the braking fraction to help control the MAP. By way of example, if all the working chambers are deactivated for a period of time, the MAP tends to equalize with the atmospheric pressure. For some situations, a high MAP is not desirable. For instance, if the accelerator pedal is suddenly depressed, the vehicle may lurch forward abruptly, because the high MAP causes a relatively large amount of air to enter the working chambers of the engine. An effective approach is to operate selected working cycles in a braking mode. This draws air from the intake manifold and thereby causes a controlled reduction of the MAP. Accordingly, when the accelerator pedal is depressed, the transition between coasting and acceleration is smoother. In another aspect, the brake fraction determining unit can decide that the brake pedal is being aggressively depressed, and determine the engine braking fraction and throttle position to reduce the MAP with the goal of providing for a smooth transition to idle (since idle may entail a low MAP, but moderate or high fraction of cylinders being fueled and fired.) The use of skip cylinder engine braking may advantageously improve a vehicle's NVH (noise, vibration, harshness) characteristics, improving occupant comfort and vehicle drivability. A further advantage may be maintaining a low MAP for the vehicle's braking system, as the vehicle's braking system is typically assisted by the intake manifold vacuum. The embodiments described herein may be used to decrease MAP for a variety of braking and other applications, including any application described in U.S. Provisional Patent Application No. 61/682,168, which is incorporated herein in its entirety for all purposes.

Another use of the aforementioned engine braking design involves the use of a target deceleration rate. For example, consider a situation in which a vehicle is coasting and decelerating. A target deceleration rate is determined (e.g., by any suitable module in or outside the engine braking controller 120). The braking fraction determining unit then determines a braking fraction to help the vehicle achieve the target deceleration rate. In various embodiments, the braking fraction determining unit 124 also adjust a variety of other engine parameters (e.g., throttle position, gear position, MAP, cam/valve timing, ignition timing, etc.) so that the target deceleration rate is achieved.

Any and all of the described components may be arranged to refresh their determinations/calculations very rapidly. In some preferred embodiments, these determinations/calculation are refreshed on a working cycle by working cycle basis although, that is not a requirement. An advantage of the working cycle by working cycle operation of the various components is that it makes the controller very responsive to changed inputs and/or conditions. Although working cycle by working cycle operation is very effective, it should be appreciated that the various components (and especially the components before the braking timing determining module 130) can be refreshed more slowly while still providing good control (as for example by refreshing every revolution of the crankshaft, etc.).

In many preferred implementations the braking timing determining module 130 (or equivalent functionality) makes a discrete braking/deactivation decision on a working cycle by working cycle basis. This does not mean that the decision is necessarily made at the same time as the braking event (i.e., when pumping losses for the associated working chamber are generated). Thus, the braking mode decisions are typically made contemporaneously, but not necessarily synchronously, with the braking events. That is, a braking mode decision may be made immediately preceding or substantially coincident with the braking opportunity working cycle, or it may be made one or more working cycles prior to the actual working cycle. (In various embodiments, the braking mode decision is made eight cycles prior to the actual working cycle.) Furthermore, although many implementations independently make the braking mode decision for each working chamber braking opportunity, in other implementations it may be desirable to make multiple (e.g., two or more) decisions at the same time.

The braking fraction determining unit 124 and the braking timing determining module 130 may take a wide variety of different forms and their functionalities may alternatively be incorporated into the ECU 140, or provided by other more integrated components, by groups of subcomponents or using a wide variety of alternative approaches. In some implementations these functional blocks may be accomplished algorithmically using a microprocessor, ECU or other computation device, using analog or digital components, using programmable logic or in any other suitable manner.

Figure 2:
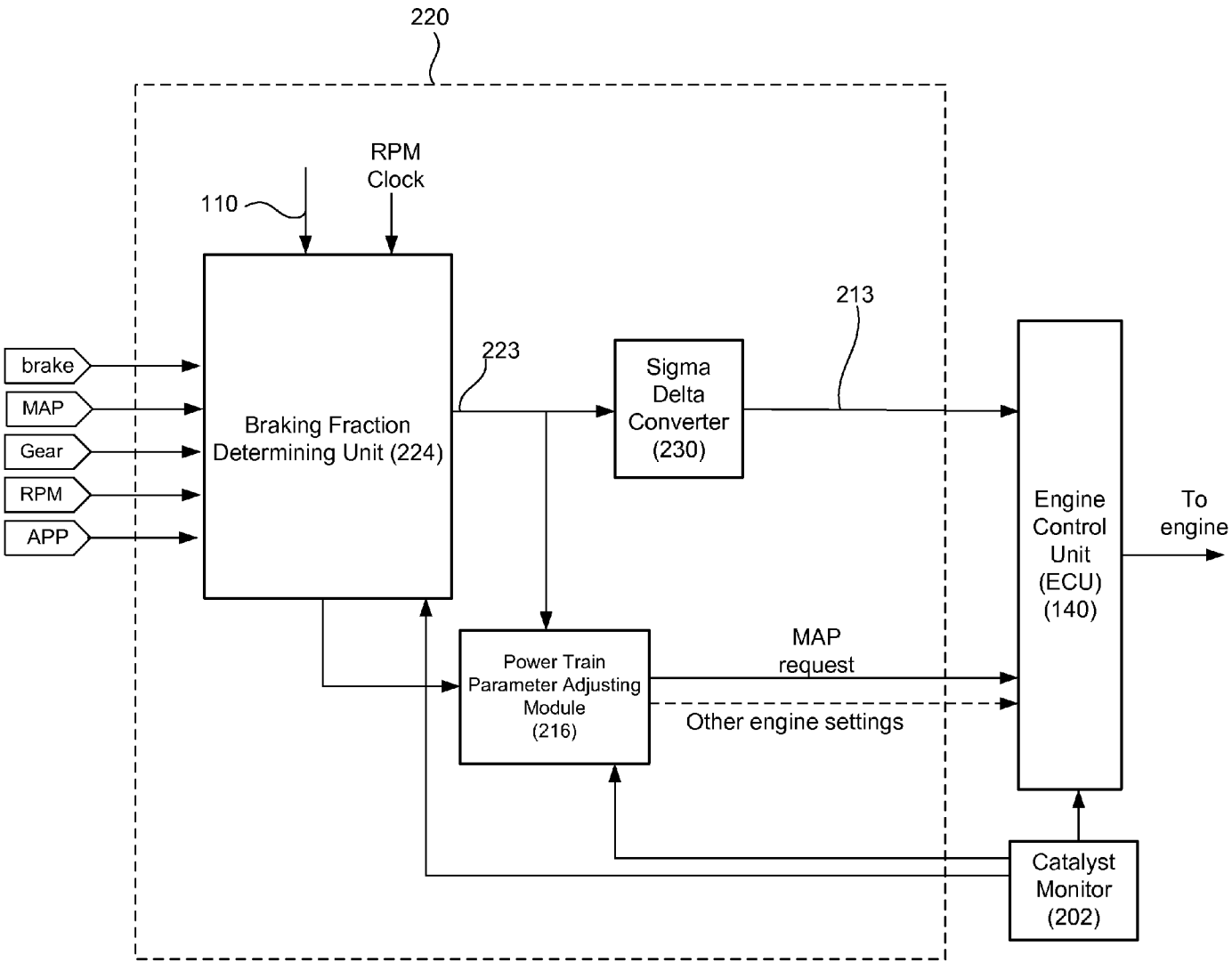
FIG. 2 is a block diagram of an engine braking controller according to another embodiment of the present invention.

Referring next to FIG. 2, another implementation of an engine braking controller 220 will be described. In the illustrated embodiment, the engine braking controller uses a control path that is separate from a firing controller (not shown in FIG. 2), although engine braking and firing controllers could use the same control path as well. The engine braking controller 220 includes a braking fraction determining unit 224, a sigma delta converter 230, a power train adjusting module 216, a catalyst monitor 202 and an engine control unit (ECU) 140, which directs the operation of an engine having multiple working chambers (not shown). The catalyst monitor may include one or more oxygen sensors. An oxygen sensor may be situated before the catalytic converter in the exhaust line and a second oxygen sensor may be situated after the catalytic converter. The first oxygen sensor allows measurement of the cylinder combustion products, while the second sensor monitors exhaust oxygen levels after the exhaust passes through the catalytic converter. Comparison of the measured oxygen levels between the two sensors allows inference of the catalytic converter state. The second oxygen sensor may be referred to as the catalyst monitor, although this term is not limited to an oxygen sensor and may be used for any monitor that allows inference of the catalyst state in the catalytic converter. Different sensors may be used for different groups of cylinders; for example, on each cylinder bank for V-style engine blocks. Similarly different cylinder groups may have their exhaust gases routed through different catalytic converters. The engine braking controller 220 may control all cylinder groups. Each cylinder group may operate with a different braking fraction as determined by the engine braking controller 220. Generally, the illustrated components function largely as their counterparts in FIG. 1, although FIG. 2 includes additional optional features that are not provided in the embodiment of FIG. 1.

The braking fraction determining unit 224 receives an input signal 110 that indicates a requested (negative) torque. The signal 110 may be generated by any suitable source, such as a cruise controller. The unit 224 may also receive input from a wide variety of other sources, including an accelerator pedal position (APP) sensor, brake pedal position sensor, manifold absolute pressure (MAP), gear setting, valve timing, and engine speed (RPM). The inputs may be received directly or indirectly. Optionally, the unit 224 may also receive input from an RPM clock.

The inputs can substantially influence the commanded braking fraction 223 generated by the braking fraction determining unit 224. For example, engine braking is generally greater at higher engine speeds, which means that a lower braking fraction may be appropriate. Accordingly, a lower gear setting tends to generate more engine braking for a particular braking fraction. In some cases, the depression of the brake pedal may be understood as a command to increase or maximize engine braking. For example, under certain conditions a commanded braking fraction 223 and corresponding braking pulse signal 213 are generated so that engine braking supports the braking action of the brake pads.

Another approach involves receiving input at the unit 224 from the engine speed sensor (RPM) and gear settings indicating that a change in gear has taken place. In this implementation, the commanded braking fraction is calculated to deliver engine braking that helps bring the current engine speed to an engine speed that is expected for the new gear setting.

An optional power train parameter adjusting module 216 is provided that cooperates with the braking fraction determining unit 224. In some implementations, the power train parameter adjusting module 216 is integrated into one or more of the other units/modules in the figure. The power train parameter adjusting module 216, which may receive one or more of the aforementioned inputs, directs the ECU 140 to set selected power train parameters appropriately to insure that the actual amount of engine braking substantially equals the desired amount of engine braking. By way of example, the power train parameter adjusting module 216 may be responsible for determining engine settings (e.g., throttle control to affect the MAP, spark timing, cam/valve timing, etc.) that are desirable to help ensure that the actual engine braking level matches the requested engine braking level.

The sigma delta converter 230 generally functions as the braking timing determining module 130 of FIG. 1. The converter is arranged to generate the braking pulse signal 213. One advantage of a sigma delta controller is that it effectively converts an input into a digital output that on average matches the input. Accordingly, a braking fraction can be converted to a braking pulse signal that is then received by the ECU 140 and used to operate the working chambers of the engine. A first order sigma delta converter works well for various applications. When a first order sigma delta converter is used, then conceptually, for any given digitally implemented input signal level (e.g., for any specific requested braking fraction), an essentially fixed repeating braking mode/deactivation pattern will be generated by the firing controller (due in part to the quantization of the input signal). In such an embodiment, a steady input would effectively cause the generation of a set braking/deactivation pattern (although the phase of the braking/deactivation sequence may be offset). Of course, in other embodiments, numerous other controllers could be used including higher order sigma-delta controllers, other predictive adaptive controllers, look-up table based converters, or any other suitable converter or controller which is arranged to deliver the braking fraction requested by the commanded braking fraction signal 223.

The engine braking controller 220 may also include a catalyst monitor 202. The catalyst monitor monitors the status of the catalytic converter. As previously discussed, if too much uncombusted air is passed through the catalytic converter, the ability of the catalytic converter to remove pollutants from vehicle exhaust can be temporarily reduced. The braking mode techniques described above can be used to recondition the catalytic converter based on the data received in the catalytic monitor.

In the illustrated embodiment, the catalyst monitor 202 sends information to the braking fraction determining unit 224, the ECU 140 and/or the power train parameter adjustment module 216 regarding the state of the catalytic converter. The information from the catalytic converter, for example, may indicate that too much unheated air has been passed through the catalytic converter, thus lowering its temperature and performance. The passage of such unheated air may have been caused by the prior operation of working chambers in a braking mode in which air, but not fuel, was passed through the working chambers.

Based on the information received from the catalytic monitor 202, the braking fraction determining unit 224 will select a suitable braking fraction, as previously discussed. The braking fraction determining unit 224, the ECU 140, and/or the power train parameter adjustment module 216 working either individually or in concert may take appropriate actions to recondition the catalyst. That is, selected working cycles of selected working chambers will be operated in a braking mode, as previously discussed in connection with engine braking controllers 120 and 220 in FIGS. 1 and 2. The power train parameter adjustment module 216 will ensure that for a selected period of time, the braking mode involves delivering air and fuel into the working chamber, so that the exhaust gases resulting from combustion can be used to recondition the catalytic converter. The amount of fuel and air delivery, the braking fraction, various engine parameters (e.g., spark timing) and the braking command sequence generated by the sigma delta converter 230 are calculated and coordinated so that the desired levels of catalytic converter reconditioning, braking/torque and fuel consumption are achieved.

Figure 3:
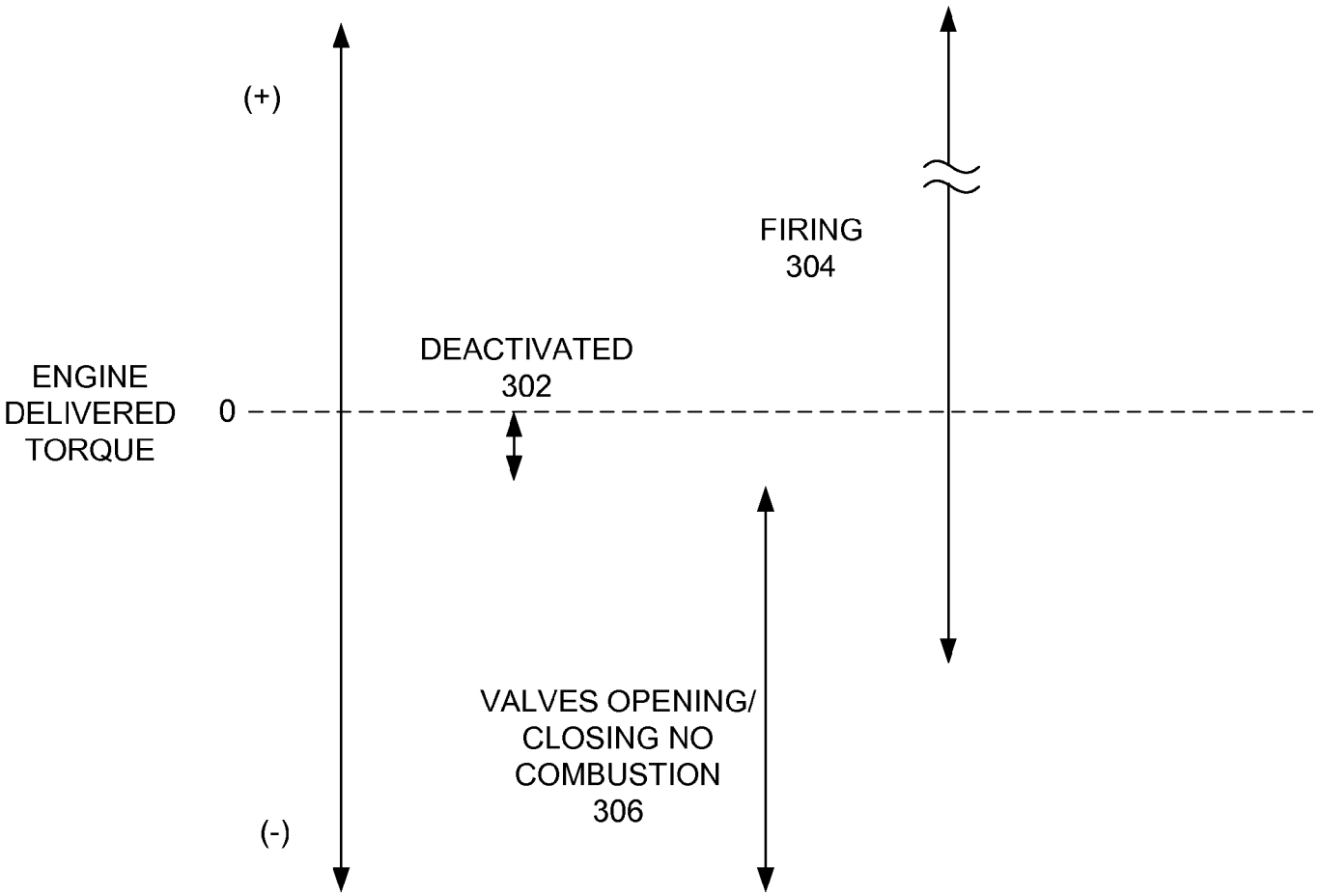
FIG. 3 is a graph illustrating various types of braking modes according to another embodiment of the present invention.

Referring next to FIG. 3, a graph illustrating the torque effects of different braking modes according to a particular embodiment of the present invention will be described. The graph illustrates three types of working chamber operational states that are represented by lines 302, 304 and 306. The length of the lines indicates the variation in torque that is possible for each operational state. It should be appreciated that the graph is intended to be illustrative in nature and should be understood as limiting neither the features nor the number of possible braking modes.

Line 302 corresponds to a braking mode in which the corresponding working chamber is deactivated. That is, the working chamber is sealed to prevent the passage of air in or out of the working chamber. Hence, the working chamber behaves similar to an air spring and generates a very small amount of negative torque.

Line 304 corresponds to a working chamber that is fired. As shown by the line 304, the firing of a working chamber can of course generate substantial amounts of positive torque. However, the present invention also contemplates a braking mode in which a working chamber is fired, but using smaller amounts of fuel and air. In this case, the pumping losses greatly outweigh the positive torque generated through combustion. Depending on the amount of fuel and air used and other engine parameters, the negative torque generated using this type of braking mode can be substantial and can vary considerably.

Line 306 corresponds to braking mode in which no fuel is delivered to the working chamber. Air is allowed in and out of the working chamber using a particular valve (e.g., an exhaust valve or an intake valve.) As indicated by the line 306, this type of braking mode can be implemented to generate a wide range of negative torque levels and has a high maximum level of negative torque.

Although skip cylinder engine braking management is described, it should be appreciated that in actual implementations, skip cylinder engine braking control does not need to be used to the exclusion of other types of engine braking control. For example, there may be operational conditions where it is desirable to conduct engine braking in a conventional mode (e.g., firing all working chambers with small amounts of fuel or allowing air into all of the working chambers without fuel delivery). Additionally or alternatively, in some designs it may be desirable to operate only a subset of the working chambers in skip cylinder engine braking mode.

One example of this approach involves arranging the working chambers of an engine into two banks, where each bank is coupled with and is arranged to pass exhaust/air through a separate catalytic converter. For at least a period of time in which engine braking is desired, only a working chamber in the first bank can be operated in a deactivated mode or a braking mode (which may involve the delivery of only air and not fuel into the working chamber). The working chambers in the second bank are limited to being deactivated and are not operated in a braking mode. As a result, air flow is channeled primarily or entirely through the catalytic converter for the first bank. This reduces or eliminates the need to fire working chambers in both banks to condition both catalytic converters.

Some engines may be equipped with various subsystems that influence the amount of engine braking. For example, the engine may have a turbocharger with variable air paths, variable length intake runners, or variable exhaust paths. All of these subsystems can be incorporated as different elements in this invention.

The invention has been described primarily in the context of controlling the engine braking of 4-stroke piston engines suitable for use in motor vehicles. However, it should be appreciated that the described engine braking approaches are very well suited for use in a wide variety of internal combustion engines. These include engines for virtually any type of vehicle—including cars, trucks, boats, aircraft, motorcycles, scooters, etc.; and virtually any other application that involves deceleration/braking and utilizes an internal combustion engine. The various described approaches work with engines that operate under a wide variety of different thermodynamic cycles—including virtually any type of two stroke piston engines, diesel engines, Otto cycle engines, Dual cycle engines, Miller cycle engines, Atkins cycle engines, Wankel engines and other types of rotary engines, mixed cycle engines (such as dual Otto and diesel engines), hybrid engines, radial engines, etc. It is also believed that the described approaches will work well with newly developed internal combustion engines regardless of whether they operate utilizing currently known, or later developed thermodynamic cycles.

The invention is equally applicable to vehicles using automatic or manual transmissions. For manual transmissions or automatic transmissions with clutches, clutch engagement locks the engine rotation to the wheel rotation so that engine braking can occur. For automatic transmissions with a torque converter clutch (TCC) the TCC may be in a controlled lock during engine braking.

The described engine braking controller may be implemented within an engine control unit. In some applications it will be desirable to provide skip cylinder engine braking control as an additional operational mode to conventional (e.g., where all working chambers are firing or in DFCO) engine braking operation. This allows the engine to be operated in a conventional mode when desired.

In some of the embodiments, it is assumed that all of the working chambers would be available for use when managing the braking fraction. However, that is not a requirement. If desired for a particular application, the engine braking controller can readily be designed to always skip some designated cycle(s).

The described skip cylinder engine braking controller can readily be used with a variety of other fuel economy and/or braking enhancement techniques. Most of the engine braking controller embodiments described above utilize sigma delta conversion. Although it is believed that sigma delta converters are very well suited for use in this application, it should be appreciated that the converters may employ a wide variety of modulation schemes. For example, pulse width modulation, pulse height modulation, CDMA oriented modulation or other modulation schemes may be used to deliver the braking pulse signal. Some of the described embodiments utilize first order converters. However, in other embodiments higher order converters may be used.

It should be appreciated that the engine braking control paths illustrated in the figures can also incorporate a skip fire control mechanism, as discussed in the aforementioned patent applications and patents that were filed by the assignee of the present application. By way of example, any suitable feature from a component in the '646 application can be integrated into a corresponding component of the present application. For this purpose, calculator 122, calculator 124, and unit 224 of the '646 application can be understood as corresponding to units 124 and 224 of the present application. Generator/controller 130 and 230 of the '646 application correspond to module/converter 130 and 230 of the present application. Power train module 133 of the '646 application corresponds to module 216 of the present application. In some implementations, any suitable element of the skip fire control described in the '646 application, which is used to determine when and how to control firing events, is applied to the control of braking events as well.

Although only a few embodiments of the invention have been described in detail, it should be appreciated that the invention may be implemented in many other forms without departing from the spirit or scope of the invention. By way of example, in this application there are references to a "skip cylinder engine braking mode." It should be appreciated that such a mode is not limited to engines with cylinders, but also can be applied to any suitable engine with one or more working chambers. In the figures, the engine braking controller or various modules are illustrated as being separate from the ECU. In other embodiments, some or all of these modules (e.g., the braking fraction determining unit, the braking timing determining module, the sigma delta converter, the power train parameter adjusting module, the catalyst monitor, etc.) are integrated into or part of the ECU. Therefore, the present embodiments should be considered illustrative and not restrictive and the invention is not to be limited to the details given herein, but may be modified within the scope and equivalents of the appended claims.

What is claimed is:

1. A method of controlling the amount of engine braking provided by an engine having at least one working chamber, the method comprising:

determining a desired amount of engine braking; and operating the engine in a skip cylinder engine braking mode that substantially delivers the desired amount of engine braking, wherein in the skip cylinder engine braking mode, selected working cycles of at least one selected working chamber are deactivated and other selected working cycles of the at least one selected working chamber are operated in a braking mode such that at least one working chamber is sometimes deactivated and sometimes operated in the braking mode, and wherein at least some of the working cycles operated in a braking mode, fuel is delivered to the working chambers operated in the braking mode, the working chambers operated in the braking mode are fired and the fired working chambers in the braking mode each generate a net negative torque.

2. A method as recited in claim 1 wherein air flow into the deactivated working chambers is cut off to minimize pumping losses.

3. A method as recited in claim 1 wherein, during the other selected working cycles, the operation of the at least one selected working chamber in the braking mode is based on a state of a catalytic converter.

4. A method as recited in claim 1 wherein, during at least some of the working cycles, air is pumped through the chambers operated in the braking mode.

5. A method as recited in claim 1 wherein only intake valves are opened during at least some of the working cycles operated in the braking mode such that no air is pumped through the associated working chamber during such working cycles operated in the braking mode.

6. A method as recited in claim 1 wherein only exhaust valves are opened during at least some of the working cycles operated in the braking mode such that no air is pumped through the associated working chamber during such working cycles operated in the braking mode.

7. A method as recited in claim 1 wherein the engine has a plurality of working chambers.

8. A method as recited in claim 7 further comprising:

while the engine is operating in the skip cylinder engine braking mode, operating a first working chamber of the plurality of working chambers in a braking mode during a first working cycle of the first working chamber; and while the engine is still operating in the skip cylinder engine braking mode, deactivating the first working chamber at a second working cycle of the first working chamber that is the next working cycle after the first working cycle.

9. A method as recited in claim 7 further comprising operating only some but not all of the working chambers in the skip cylinder engine braking mode.

10. A method as recited in claim 1 where the engine supplies the power to operate a vehicle.

11. An engine braking controller comprising:

a braking fraction determining unit arranged to determine a braking fraction that indicates the number of working cycles to operate in a braking mode to deliver a desired amount of engine braking wherein the available braking fractions are not limited to integer numbers of working chambers; and a braking timing determining unit arranged to direct the operation of working chambers in a manner that substantially delivers the selected braking fraction, wherein the braking controller is arranged to occasionally fire selected working cycles of at least one selected working chamber to help condition a catalytic converter and wherein net torque generated by the occasional firing of the selected working cycles of the at least one selected working chamber is negative.

12. An engine braking controller as recited in claim 11 further comprising a power train parameter adjusting module that is arranged to regulate the amount of engine braking by controlling at least one from the group consisting of manifold absolute pressure, throttle, spark timing and valve timing.

13. An engine braking controller as recited in claim 11 further comprising a catalyst monitor arranged to monitor the catalytic converter and wherein the selection of working cycles to be fired is based at least in part on input from the catalyst monitor.

14. An engine braking controller as recited in claim 11 wherein the braking fraction determining unit is arranged to adjust the braking fraction based on at least one selected from the group consisting of accelerator pedal position, cruise control settings, brake pedal activation, manifold air pressure, throttle position, transmission gear ratio, and engine speed.

15. An engine braking controller as recited in claim 11 wherein the braking timing determining unit includes a sigma delta converter, the sigma delta converter being arranged to determine whether each working chamber is operated in the braking mode or deactivated.

16. A method of controlling the amount of engine braking in an engine having a plurality of working chambers, the method comprising:

setting a braking fraction that indicates a fraction of working cycles to operate in a braking mode to deliver a desired amount of engine braking;

determining a braking pattern that indicates on a working cycle by working cycle basis whether selected working chambers should be operated in a braking mode or deactivated; and operating the engine in accordance with the braking pattern wherein:

each time a working chamber is operated in the braking mode, air is introduced into the working chamber in a manner that causes pumping losses that help deliver the desired amount of engine braking; and each time a working chamber is deactivated, air flow through the deactivated working chamber is cut off such that pumping losses are minimized; and occasionally firing selected working cycles of at least one selected working chamber to help condition a catalytic converter, wherein net torque generated by the firing of the selected working cycles of the at least one selected working chamber is negative.

17. A method as recited in claim 16 further comprising:

receiving input from a catalyst monitor that monitors a catalytic converter; and the selection of the selected working cycles to be fired is based at least in part on input from the catalyst monitor.

18. A method as recited in claim 16 further comprising:

determining that a target speed has been set using cruise control; and setting the braking fraction to substantially reach the target speed.

19. A method as recited in claim 16 further comprising:

determining that a brake pedal has been depressed to slow the motion of a vehicle;

engaging brake pads to supply negative torque to slow the vehicle;

using skip cylinder engine braking to supply negative torque to slow the vehicle to brake the wheels of the vehicle; and based at least in part on the depression of the brake pedal, setting a ratio between negative torque produced by the skip cylinder braking fraction and the brake pad engagement to slow or stop the vehicle.

20. A method as recited in claim 16 further comprising adjusting negative torque output of at least one of the working chambers in braking mode by regulating at least one selected from the group consisting of spark timing, valve timing, throttle and manifold air pressure.

21. A method as recited in claim 16 further comprising:

determining that a brake pedal has been aggressively depressed to rapidly slow the motion of a vehicle; and adjusting the throttle and braking fraction so as to reduce the manifold absolute pressure.

22. A method as recited in claim 1 wherein during at least some of the working cycles operated in the braking mode air is allowed in and out of the associated working chamber through a valve such that no air is pumped through the associated working chamber during such working cycles operated in the braking mode.

23. A method as recited in claim 22 wherein the valve through which air is allowed in and out of the associated working chamber is an intake valve.

24. A method as recited in claim 22 wherein the valve through which air is allowed in and out of the associated working chamber is an exhaust valve.

25. A method as recited in claim 1 further comprising:

detecting that a performance of the catalytic converter is degraded; and based on the detected catalytic converter performance, determining that a selected working chamber in the braking mode should be fired during a selected working cycle to help improve performance of the catalytic converter; and operating the selected working chamber in the braking mode during the selected working cycle and firing the selected working cycle of the selected working chamber such that the fired working chamber generates net negative torque during the selected working cycle.

26. An engine braking controller as recited in claim 11 wherein the engine braking controller is arranged to direct operation of a working chamber in the braking mode based on a state of a catalytic converter.

27. An engine braking controller as recited in claim 11 wherein the determination of whether each working chamber is operated in the braking mode or deactivated is made on a working cycle by working cycle basis.

28. A method as recited in claim 16 wherein operation of a working chamber in the braking mode is based on a state of a catalytic converter.

29. A method as recited in claim 16 wherein the determination of whether each of the selected working chambers should be operated in the braking mode or deactivated is performed on a working cycle by working cycle basis.

* * * * *